US011371399B2

(12) United States Patent
Osada et al.

(10) Patent No.: US 11,371,399 B2
(45) Date of Patent: Jun. 28, 2022

(54) OIL RETURN STRUCTURE

(71) Applicant: ISUZU MOTORS LIMITED, Tokyo (JP)

(72) Inventors: Hideki Osada, Fujisawa (JP); Hitoshi Nishitani, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 0 days.

(21) Appl. No.: 16/969,933

(22) PCT Filed: Feb. 12, 2019

(86) PCT No.: PCT/JP2019/004797
§ 371 (c)(1),
(2) Date: Aug. 13, 2020

(87) PCT Pub. No.: WO2019/159872
PCT Pub. Date: Aug. 22, 2019

(65) Prior Publication Data

US 2021/0010398 A1 Jan. 14, 2021

(30) Foreign Application Priority Data

Feb. 13, 2018 (JP) ..... JP2018-023180

(51) Int. Cl.
*F01M 11/02* (2006.01)
*F01M 11/00* (2006.01)
(Continued)

(52) U.S. Cl.
CPC ..... *F01M 11/02* (2013.01); *F01M 11/0004* (2013.01); *F01M 11/08* (2013.01); *F01M 13/04* (2013.01); *F01M 2011/023* (2013.01)

(58) Field of Classification Search
CPC .... F01M 11/02; F01M 11/0004; F01M 11/08; F01M 2011/023; F01M 13/04; F01M 2013/005
See application file for complete search history.

(56) References Cited

U.S. PATENT DOCUMENTS 6,089,213 A * 7/2000 Laudien ..... F01M 13/04 123/572
6,520,164 B1 * 2/2003 Lepp ..... F01M 13/04 123/572
(Continued)

FOREIGN PATENT DOCUMENTS

CN 101260819 A 9/2008
CN 206309442 U 7/2017
(Continued)

OTHER PUBLICATIONS

International Search Report and Written Opinion for related Int. App. PCT/JP2019/004797 dated Mar. 19, 2019. English translation provided; 9 pages.
(Continued)

*Primary Examiner* — Syed O Hasan
(74) *Attorney, Agent, or Firm* — Procopio, Cory, Hargreaves & Savitch LLP

(57) ABSTRACT

This oil return structure is provided with a flow passage body configured to return oil into an engine body which communicates with an oil storage section of the engine, the oil having been separated from a blow-by gas by an oil separation means. The upstream end of the flow passage body is connected to the oil separation means, at least a portion of the downstream side of the flow passage body protrudes into the engine body from the inner wall thereof, and an oil discharge opening at tire downstream end of the
(Continued)

flow passage body is disposed at a position not immersed in oil within the oil storage section.

4 Claims, 4 Drawing Sheets

(51) Int. Cl.
*F01M 11/08* (2006.01)
*F01M 13/04* (2006.01)

(56) References Cited

U.S. PATENT DOCUMENTS

| | | | | |
|---|---|---|---|---|
| 7,506,629 | B2 * | 3/2009 | Kawamura | F01M 13/0416 123/195 C |
| 8,978,631 | B2 * | 3/2015 | Shudo | F01M 13/023 123/41.86 |
| 2003/0019484 | A1 | 1/2003 | Lepp et al. | |
| 2009/0241921 | A1 | 10/2009 | Ito et al. | |
| 2010/0147255 | A1 | 6/2010 | Toda | |
| 2011/0088641 | A1 | 4/2011 | Shudo et al. | |
| 2017/0167331 | A1 | 6/2017 | Park et al. | |

FOREIGN PATENT DOCUMENTS

| | | | |
|---|---|---|---|
| JP | S59137313 | U | 9/1984 |
| JP | S60-047821 | A | 3/1985 |
| JP | S61005310 | U | 1/1986 |
| JP | H01124012 | U | 8/1989 |
| JP | 2003-097243 | A | 4/2003 |
| JP | 2007-309130 | A | 11/2007 |
| JP | 2008025347 | A | 2/2008 |
| JP | 2011085118 | A | 4/2011 |
| JP | 2011-231686 | A | 11/2011 |
| JP | 2017-048771 | A | 3/2017 |
| JP | 2017-031877 | A | 9/2017 |

OTHER PUBLICATIONS

Japanese Patent Office, Notice of Reasons for Refusal, JP Application No. 2018-023180, dated Aug. 25, 2021, in 8 pages.

The State Intellectual Property Office of People's Republic of China, The First Office Action, CN Application No. 201980013172.3, dated Aug. 9, 2021.

* cited by examiner

[Fig. 1]
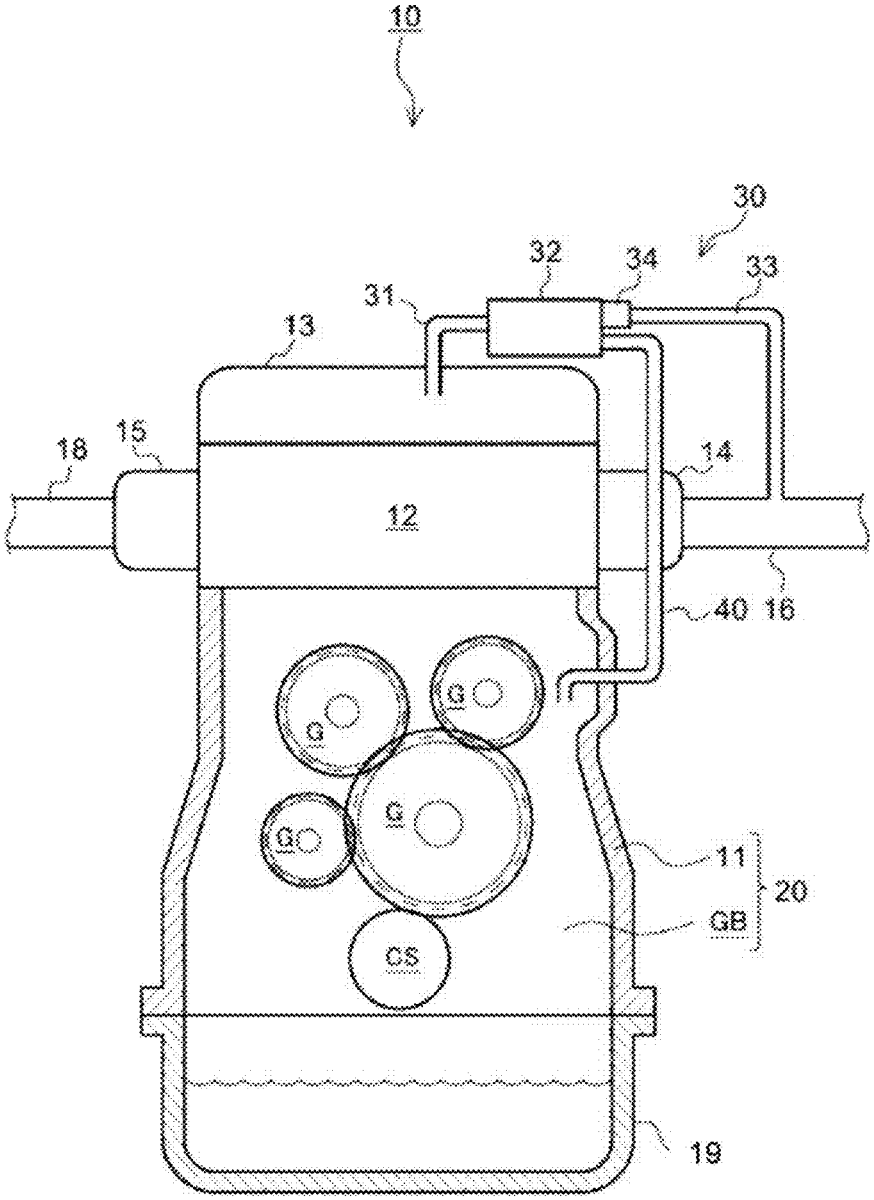

[Fig. 2]
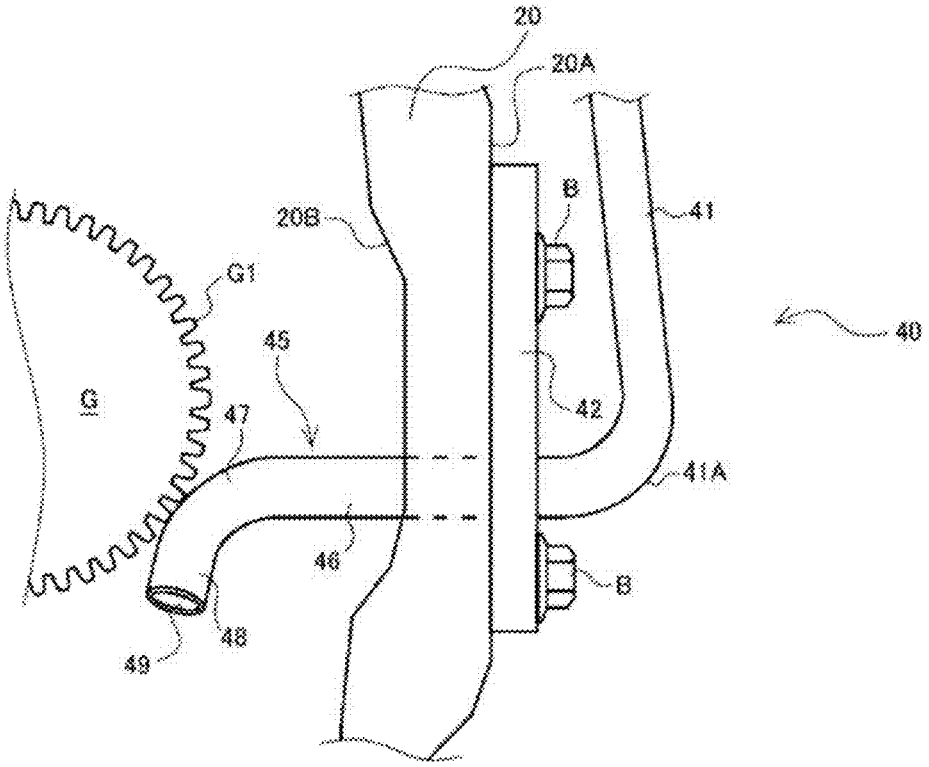

[Fig. 3]
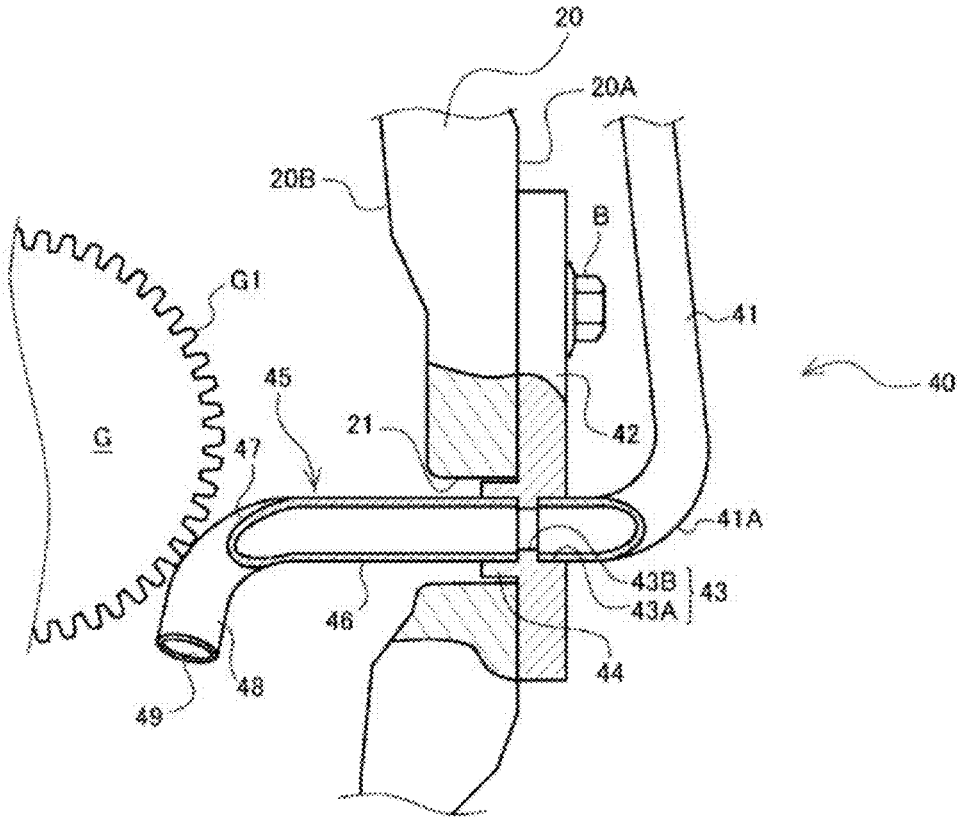

[Fig. 4]
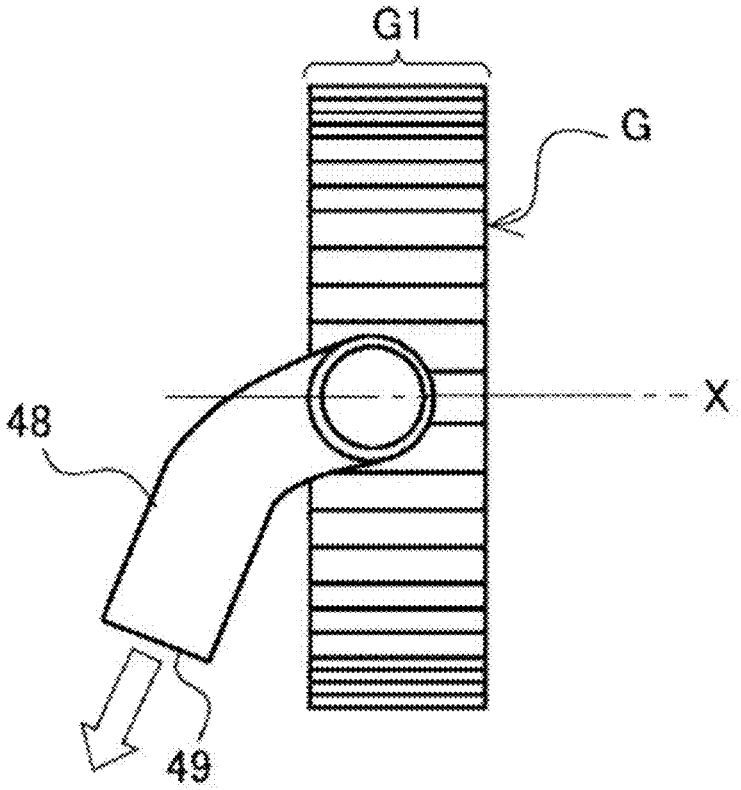

OIL RETURN STRUCTURE

TECHNICAL FIELD

The present disclosure relates to an oil return structure, and more particularly to an oil return structure for a Positive Crankcase Ventilation (PCV) device.

BACKGROUND ART

Generally, in this type of PCV device, oil separated from blow-by gas by an oil separator (hereinafter, referred to separated oil) is returned to an oil pan through a return pipe connected to an engine body.

When an oil discharge port of the return pipe is opened on an inner wall surface of the engine body, the oil flowing along the inner wall surface or oil splash scattered from a rotating body in the engine body may flow into the return pipe from the oil discharge port, thereby causing a backflow.

As a structure capable of preventing such a backflow, for example, in Patent Literature 1, the following structure is disclosed: a return pipe connected to an oil separator is inserted into an engine body; and an oil discharge port of the return pipe is immersed in an oil in an oil pan.

CITATION LIST

Patent Literature

Patent Literature 1: JP-A-2008-25347

SUMMARY OF INVENTION

Technical Problem

Now in a structure as described in the above Patent Literature 1, the return pipe is formed in a long shape from a side wall of the engine body to the oil pan through a crank chamber. For this reason, the long-shaped return pipe may be broken due to influences of the vibration of an engine and a fluid pressure of the oil that flows in the crank chamber and/or the oil pan. In addition, if the return pipe is made thicker to ensure the strength in order to prevent the breakage, there is also a problem that the cost is increased. Furthermore, an increase in the length of a flow path of the return pipe may decrease a drain efficiency of a separated oil, and may cause blockage (clogging) due to a deteriorated oil and the like.

The technology of the present disclosure provides an oil return structure that effectively prevents backflow of oil with a simple configuration.

Solution to Problem

According to an oil return structure of the present disclosure, there is provided a flow path body configured to return an oil separated from a blow-by gas by an oil separation unit into an engine body which communicates with an oil storage portion of an engine. An upstream end of the flow path body is connected to the oil separation unit, at least a part on a downstream side of the flow path body protrudes into the engine body from an inner wall of the engine body, and an oil discharge port at a downstream end of the flow path body is disposed at a position that is not immersed in an oil within the oil storage portion.

A rotating body may be housed in the engine body, and the oil discharge port of the flow path body may be disposed to be offset in a rotation axis direction with respect to a rotational outer peripheral surface of the rotating body.

The flow path body may include a pipe member that protrudes from a side wall inner surface of the engine body to the inside of the engine body.

Furthermore, the pipe member may include a first straight pipe portion that extends laterally from the side wall inner surface, a curved pipe portion that curves from a downstream end of the first straight pipe portion in a direction obliquely downward from the rotation axis direction, and a second straight pipe portion that extends downward from a downstream end of the curved pipe portion, and an oil discharge port may be formed at a downstream end of the second straight pipe portion.

Advantageous Effects of Invention

According to the technology of the present disclosure, a backflow of the oil can be prevented with a simple configuration.

BRIEF DESCRIPTION OF DRAWINGS

FIG. 1 is a schematic overall configuration diagram of a PCV device including an oil return structure according to the present embodiment.

FIG. 2 is a schematic diagram showing a main part of an oil return pipe portion according to the present embodiment.

FIG. 3 is a schematic partial sectional view showing the oil return pipe portion shown in FIG. 2 with a part thereof cut out.

FIG. 4 is a schematic view of a second straight pipe portion of a downstream pipe member according to the present embodiment as viewed from a gear radial direction.

DESCRIPTION OF EMBODIMENTS

Hereinafter, an oil return structure according to the present embodiment will be described with reference to the accompanying drawings. The same components are denoted by the same reference numerals, and names and functions of these components are also the same. Therefore, a detailed description of the same components is not repeated.

[Overall Configuration]

FIG. 1 is a schematic overall configuration diagram of a PCV device 30 including the oil return structure according to the present embodiment. An engine 10 includes a cylinder block 11. A cylinder head 12 is provided at an upper portion of the cylinder block 11, and a cylinder head cover 13 is attached to an upper portion of the cylinder head 12. Also, an oil pan 19 (oil storage portion) for storing engine oil is provided at a lower portion of the cylinder block 11. Furthermore, the cylinder block 11 is provided with a gear box GB that accommodates a plurality of gears G that transmit rotational power of a crankshaft CS to auxiliary machines and the like (not shown). Internal spaces of the cylinder block 11 and the gear box GB both communicate with the oil pan 19.

Note that in the following description, the cylinder block 11 and the gear box GB are simply referred to as "engine body 20". In the present embodiment, the "engine body 20" referred thus surely includes the cylinder block 11 and/or the gear box GB.

An intake manifold 14 and an exhaust manifold 15 are provided on side portions of the cylinder head 12. An intake pipe 16 that introduces fresh air is connected to the intake manifold 14, and an exhaust pipe 18 that discharges exhaust gas is connected to the exhaust manifold 15.

The PCV device 30 recirculates, to an intake system (or is released to the atmosphere), a blow-by gas leaked to a crank chamber side from a gap between a cylinder and a piston (not shown) formed in the cylinder block 11. Specifically, the PCV device 30 includes an upstream gas pipe portion 31, an oil separator 32 (an example of an oil separation unit), a downstream gas pipe portion 33, a PCV valve 34, and an oil return pipe portion 40 (an example of a flow path body).

The upstream gas pipe portion 31 connects a gas outlet portion of the cylinder head cover 13 to a gas inlet portion of the oil separator 32, and introduces the blow-by gas leaked to the crank chamber side into the oil separator 32. The oil separator 32 separates the oil front the blow-by gas.

The downstream gas pipe portion 33 connects a gas outlet portion of the oil separator 32 to the intake pipe 16, and recirculates the blow-by gas in which the oil is separated by the oil separator 32 into the intake pipe 16. Note that an outlet end of the downstream gas pipe portion 33 may be opened to the atmosphere. The PCV valve 34 is provided adjacent to the gas outlet portion of the oil separator 32, and functions as, for example, a check valve.

The oil return pipe portion 40 connects an oil outlet portion of the oil separator 32 to die engine body 20. The oil return pipe portion 40 functions to return the oil (hereinafter, referred to as "separated oil") separated from the blow-by gas by the oil separator 32 to the inside of the engine body 20. The separated oil discharged from the oil return pipe portion 40 into the engine body 20 is configured to be returned into the lower oil pan 19 by falling due to the force of gravity. Hereinafter, a detailed configuration of the oil return pipe portion 40 will be described.

[Oil Return Pipe Portion]

FIG. 2 is a schematic diagram showing a main part of the oil return pipe portion 40 according to the present embodiment, and FIG. 3 is a schematic partial sectional view showing the oil return pipe portion 40 shown in FIG. 2 with a part thereof cut out.

As shown in FIGS. 2 and 3, the oil return pipe portion 40 includes an upstream pipe member 41, a bracket 42, and a downstream pipe member 45 in order from an upstream side in a returning direction of the separated oil.

The upstream pipe member 41 is a substantially cylindrical tubular member and is disposed on an outer side of the engine body 20. An upstream end of the upstream pipe member 41 is connected to the oil outlet portion of the oil separator 32 (see FIG. 1). The upstream pipe member 41 extends in a substantially vertical direction on the outer side of the engine body 20 along a side wall outer surface 20A of the engine body 20, and is formed in a curve such that a downstream side 41A thereof faces the engine body 20.

The bracket 42 is a thick plate-shaped member, and is preferably made of a metal material and the like. The bracket 42 is fixed to the side wall outer surface 20A of the engine body 20 by a pair of bolts B. An insertion hole 21 (see FIG. 3) is formed through a side wall portion of the engine body 20 to which the bracket 42 is fixed. Also, a through hole 43 (see FIG. 3) is formed at a portion corresponding to the insertion hole 21 of the bracket 42. The through hole 43 is formed as a stepped hole such that the hole diameter of an outer opening hole portion 43A is substantially the same as the pipe outer diameter of the upstream pipe member 41, and that the hole diameter of an inner opening hole portion 43B is substantially the same as the pipe inner diameter of the upstream pipe member 41. A downstream end of the upstream pipe member 41 is fitted into the outer opening hole portion 43A.

Furthermore, a cylindrical protrusion 44 (see FIG. 3) that surrounds an opening edge of the opening hole portion 43B is provided to protrude from an inner side surface of the bracket 42. The cylindrical outer diameter of the cylindrical protrusion 44 is formed to be smaller than the hole diameter of the insertion hole 21, and the cylindrical inner diameter of the cylindrical protrusion 44 is formed to be substantially the same as the pipe outer diameter of the downstream pipe member 45. An upstream end of the downstream pipe member 45 is fitted into the cylindrical protrusion 44. The cylindrical protrusion 44 and the downstream pipe member 45 are preferably fixed to each other by brazing or the like.

The downstream pipe member 45 is a substantially cylindrical tubular member, and is preferably formed of a heat-resistant member (for example, metal). Specifically, the downstream pipe member 45 integrally includes a first straight pipe portion 46, a curved pipe portion 47, and a second straight pipe portion 48 in order from the upstream side. A downstream end of the second straight pipe portion 48 is formed as an oil discharge port 49 that opens into the engine body 20.

An outer circumference of an upstream end of the first straight pipe portion 46 is fixed to an inner cylindrical surface of the cylindrical protrusion 44 of the bracket 42 and communicates with the through hole 43. Also, the first straight pipe portion 46 is provided extend in a lateral direction that is substantially perpendicular to a side wall inner surface 20B in the engine body 20, and protrude from the side wall inner surface 20B to the internal space of the engine body 20. That is, the oil that flows down along the side wall inner surface 20B of the engine body 20 is adapted to be effectively prevented from flowing into the through hole 43 and/or the upstream pipe member 41 by an outer peripheral surface of the first straight pipe portion 46.

The curved pipe portion 47 is formed to be curved obliquely downward from a downstream end of the first straight pipe portion 46. In this way, when the curved pipe portion 47 is directed obliquely downward, the oil flowing along the outer peripheral surface of the first straight pipe portion 46 from the side wall inner surface 20B is reliably dropped downward. The second straight pipe portion 48 is provided at a downstream end of the curved pipe portion 47.

The second straight pipe portion 48 is provided to extend from the downstream end of the curved pipe portion 47 in a direction obliquely downward from a direction of a rotation axis X of a tooth surface G1 (a left direction in the illustrated example). In the present embodiment, the oil discharge port 49 of the second straight pipe portion 48 is preferably provided in a position vertically above the crankshaft CS (see FIG. 1) such that die oil discharge port 49 is not immersed in oil in the oil pan 19 (see FIG. 1) and that the entire downstream pipe member 45 is short.

Furthermore, as shown in FIG. 4, the oil discharge port 49 of the second straight pipe portion 48 is disposed to be offset by a predetermined amount in one of the directions of the rotation axis X (the left direction in the illustrated example) with respect to the tooth surface G1 so as to prevent the oil splash scattered from the tooth surface G1 from flowing thereinto from the tooth surface (an example of a rotational outer peripheral surface) G1 of the gear G which is a rotating body. The amount of offset of the oil discharge port 49 may be appropriately set within a range in which the flow of the oil splash can be prevented in accordance with the number of teeth of the gear G and a tooth width.

According to the present embodiment described in detail above, the first straight pipe portion 46 of the downstream pipe member 45 is provided to protrude laterally from the side wall inner surface 20B of the engine body 20 to the inside of the engine body 20. In this way, the oil that flows down along the side wall inner surface 20B of the engine body 20 is effectively prevented from flowing into the through hole 43 and/or the upstream pipe member 41 by the first straight pipe portion 46, and the backflow of the oil can be reliably prevented.

Also, the oil discharge port 49 of the downstream pipe member 45 is disposed to be offset in the direction of the rotation axis X with respect to the tooth surface G1 of the gear G. In this way, it may be achieved that the oil splash scattered from the gear G is effectively prevented from flowing into the oil discharge port 49, so that the backflow of the oil from the oil discharge port 49 can be reliably prevented.

Also, since the oil discharge port 49 is disposed at a position that is not immersed in the oil in the oil pan 19, a decrease in drain efficiency of a separated oil can be effectively prevented. Furthermore, since the downstream pipe member 45 is formed in a short shape, it is possible to reduce influences from the vibration of the engine 10, the fluid pressure of the oil flowing in the engine body 20 and the like, and breakage due to the vibration, the fluid pressure, and the like can be effectively prevented.

Also, since the downstream pipe member 45 is formed in a short shape, the downstream pipe member 45 can be easily inserted into the insertion hole 21 of the engine body 20 in a state of being preassembled to the bracket 42 and the upstream pipe member 41, so that the assembling workability can be reliably improved.

The present disclosure is not limited to the above described embodiment and can be appropriately modified and implemented without departing from the spirit of the present disclosure.

For example, in the above embodiment, although the rotating body has been described by taking the gear G as an example, the rotating body may be a balance weight of the crankshaft CS when the oil return pipe portion 40 is connected to the crank chamber. In this case, the oil discharge port 40 may be disposed to be offset in a crankshaft direction with respect to the balance weight.

Also, the oil return pipe portion 40 may be connected to, for example, a housing such as an air compressor as long as the oil return pipe portion 40 is a structure including a space portion that communicates with the oil pan 19. When the oil return pipe portion 40 is connected to the air compressor, the oil discharge port 49 may be disposed to be offset from the rotational outer peripheral surface of the rotating body (for example, a crank) in the housing in the rotation axis direction.

The present application is based on Japanese Patent Application (No. 2018-023180) filed on Feb. 13, 2018, contents of which are incorporated herein as reference.

INDUSTRIAL APPLICABILITY

The present disclosure can provide an oil return structure that effectively prevents backflow of oil with a simple configuration.

REFERENCE SIGNS LIST

10 engine
11 cylinder block (engine body)
GB gear box (engine body)
G gear (rotating body)
CS crankshaft
12 cylinder head
13 cylinder head cover
19 oil pan (oil storage portion)
20 engine body
21 insertion hole
30 PCV device
31 upstream gas pipe portion
32 oil separator (oil separation unit)
33 downstream gas pipe portion
34 PCV valve
40 oil return pipe portion
41 upstream pipe member (flow path body)
42 bracket
45 downstream pipe member (flow path body)
46 first straight pipe portion
47 curved pipe portion
48 second straight pipe portion
49 oil discharge port

The invention claimed is:

1. An oil return structure comprising:

a flow path body configured to return an oil separated from a blow-by gas by an oil separation unit into an engine body which communicates with an oil storage portion of an engine, wherein an upstream end of the flow path body is connected to the oil separation unit, at least a part on a downstream side of the flow path body protrudes into the engine body from an inner wall of the engine body, and an oil discharge port at a downstream end of the flow path body is disposed at a position that is not immersed in an oil within the oil storage portion, wherein a rotating body is housed in the engine body, wherein the oil discharge port of the flow path body is disposed to be offset in a rotation axis direction with respect to a rotational outer peripheral surface of the rotating body, wherein the oil discharge port of the flow path body is disposed at a position above the oil storage portion, and wherein the oil discharge port of the flow path body is disposed at a position above a crankshaft housed in the engine body.

2. The oil return structure according to claim 1, wherein the flow path body includes a pipe member that protrudes from a side wall inner surface of the engine body to an inside of the engine body.

3. The oil return structure according to claim 2, wherein the pipe member includes a first straight pipe portion that extends laterally from the side wall inner surface, a curved pipe portion that curves from a downstream end of the first straight pipe portion in a direction obliquely downward from the rotation axis direction, and a second straight pipe portion that extends downward from a downstream end of the curved pipe portion, and wherein the oil discharge port is formed at a downstream end of the second straight pipe portion.

4. The oil return structure according to claim 1, wherein the rotating body is a gear of a gearbox configured to transmit rotational power from the crankshaft.

* * * * *